United States Patent [19]

Sen

[11] 4,150,001

[45] Apr. 17, 1979

[54] DETERGENT BARS CONTAINING ALKALINE EARTH METAL HYDROGEN ORTHOPHOSPHATE

[75] Inventor: Bishnu P. Sen, Bombay, India

[73] Assignee: Lever Brothers Company, New York, N.Y.

[21] Appl. No.: 800,773

[22] Filed: May 26, 1977

[51] Int. Cl.[2] ..... C11D 17/00; C11D 3/065; C11D 3/06

[52] U.S. Cl. ..... 252/539; 252/134; 252/135; 252/174; 252/DIG. 16

[58] Field of Search ..... 252/135, 539, 134, 174, 252/DIG. 16, 133

[56] References Cited

U.S. PATENT DOCUMENTS

| | | | |
|---|---|---|---|
| 3,178,370 | 4/1965 | Okenfuss | 252/539 X |
| 3,340,196 | 9/1967 | Anstett et al. | 252/135 X |
| 3,674,700 | 7/1972 | Gaiser | 252/DIG. 16 X |

FOREIGN PATENT DOCUMENTS 1242886 8/1971 United Kingdom.

*Primary Examiner*—Harris A. Pitlick
*Attorney, Agent, or Firm*—James J. Farrell; Melvin H. Kurtz; Michael J. Kelly

[57] ABSTRACT

A built detergent bar has its sogginess reduced by including from 1% to 40% of $XHPO_4$, wherein X is calcium or magnesium. The presence of silicates assists the phosphate in its action.

3 Claims, No Drawings

DETERGENT BARS CONTAINING ALKALINE EARTH METAL HYDROGEN ORTHOPHOSPHATE

This invention relates to detergent bars and particularly to bars containing synthetic detergents. One use of these detergent bars is in laundry work.

These bars will usually contain from about 15% to about 65% by weight of detergent active which may include an amount of soap. The detergent active is usually one or more anionic synthetic detergent actives, for example, alkyl benzene sulphonate, alkyl sulphate, olefin sulphonate, and alkyl ether sulphate. Nonionic detergent actives, for example, ethoxylated alcohols, may also be used. Examples of detergent actives usable will be found in volume I of "Surface Active Agents and Detergents" by Schwartz and Perry and volume II by Schwartz, Perry and Berch (Interscience 1958). There is no criticality in the use of detergent active materials. Normally the amount of detergent active material will be in the range from about 15% to about 35%.

Detergent bars will also contain detergency builder materials in an amount of from about 5% to about 60% by weight. Examples of such materials are phosphates, preferably tripoly-phosphate and orthophosphates. Examples of detergency builders are quoted in the two volumes by Schwartz, Perry & Berch quoted previously. Other components to give good processing or use properties will also be present. Examples of these other components are silicates, sodium carboxymethyl cellulose, fluorescers, germicides, perfumes, pigments, talc, sodium sulphate, opacifiers, starch and lather boosters. Urea in an amount of up to about 12% may also be present as a plasticizer. Water will also be present in the product.

The bars are usually manufactured by mixing the components together with suitable binders and subjecting them to the processing steps used for soap bars. In the production and use the bars are required to have specific properties, for example good bar strength, lather and detergency and low sogginess in use.

The present invention defines detergent bars having reduced sogginess during storage and in use. Sogginess arises from an absorption of water which can take place during storage by absorption from the atmosphere and during use by physical contact with water.

The present invention provides a detergent bar, in which the sogginess is reduced, containing from about 15% to about 65% by weight of detergent active material, from about 5% to about 60% by weight of detergency builder material, from about 1% to about 40% by weight of alkaline earth metal hydrogen orthophosphate of formula $XHPO_4$ wherein X is calcium or magnesium or mixture thereof, the remainder being conventional ingredients.

The preferred alkaline earth metal is calcium. Addition of a phosphate with the defined formula also assists in the processing of the bar and increases the bar strength in use. The presence of a phosphate of the defined formula allows a bar to have reduced sogginess even when containing up to about 20% water. A detergent bar of the invention has good wear properties in use.

The amounts in the formulation above are quoted by weight of the anhydrous materials. The alkaline earth metal phosphates can be associated with up to two molecules of water of crystallisation but this water is not taken into account when calculating the required weight of phosphate. Preferably the bars contain at least about 5% of the alkaline earth metal phosphates.

The presence of a silicate in an amount of from about 5% to about 30% in the bar is preferred. This component assists the alkaline earth metal phosphate in providing a bar with increased hardness and reduced sogginess.

Incorporation of the alkaline earth metal phosphates defined also improve bar processing by reducing the time between mixing the formulation and stamping the bars. With an alkaline earth metal phosphate present the time can be reduced to about ½ hour.

The calcium hydrogen phosphate defined is also known as dicalcium orthophosphate and this latter term will be used in the specification.

The use of the defined phosphates in detergent bars is of particular use when water soluble salts, for example sodium or potassium salts, of linear alkyl ($C_8$ to $C_{20}$) benzene sulphonates are used. Bars containing this class of detergent actives are particularly susceptible to develop softness after plodding and take long time for hardening so that they are difficult to stamp. These actives contain linear alkyl groups with the benzene ring attached randomly along the chain except at the end carbon atoms. They are prepared by sulphonation of alkyl benzenes which may be formed by two processes. In one process an appropriate chloroparaffin is reacted with benzene in the prescence of a Friedal-Crafts catalyst, for example aluminium chloride. In the second process olefine and benzene are reacted in the presence of hydrogen fluoride. These processes provide substantially identical products but the first process provides generally a higher content of the isomer having the benzene group attached to the second carbon atom in the chain.

After sulphonation the acid may be neutralised to provide the desired salt; alternatively the acid may be added as a component with neutralisation occurring in situ.

Examples of detergent bars according to the invention will now be given.

Detergent bars I,II,III, and IV of the invention and a control bar containing components as set out in Table I were prepared by dry mixing the components, plodding and stamping to form detergent bars.

Table I

| Bar: | I | II | III | IV | Control |
|---|---|---|---|---|---|
| Sodium alkyl ($C_{12}$) benzene sulphonate | 19 | 19 | 19 | 19 | 21 |
| Sodium tripolyphosphate | 19 | 19 | 19 | 19 | 21 |
| Dicalcium orthophosphate | 5 | 29 | 24 | 9 | nil |
| Sodium alkaline silicate | 15 | 5 | 10 | 10 | 3 |
| Talc | 19 | 5 | 5 | 19 | 31 |
| Wax | 5 | 5 | 5 | 5 | 5 |
| Sodium carboxy methyl cellulose | 2 | 2 | 2 | 2 | 2 |
| Moisture | 15 | 15 | 16 | 15 | 13 |
| other minor components*, (e.g. dyes, fluorescers, stabilisers, perfumes) | 1 | 1 | 2 | 2 | 2 |

*This category will include adventitious material for example nondetergent organic materials and inorganics, in addition to deliberately added components.

The amount of each component is given approximately in weight percentage expressed as the anhydrous materials.

The ingredients for a 2 Kg. batch were charged into a sigma mixer in the order: alkyl benzene sulphonic acid, soda ash, sodium silicate, sodium tripoly phosphate, wax, talc, minor ingredients, dicalcium orthophosphate.

Steam was passed through the jacket of the sigma mixer to maintain a temperature in the range 35° to 60° C. The final moisture content of the mass was measured with an Infra-red moisture balance. When the mass was found to be of the correct composition it was milled and plodded using a plodder with a heated nozzle.

The sogginess of the bars "on-storage" and "in-use" were assessed. The "in-use" sogginess of the bars was assessed every morning after wash-down on the previous day. In the wash-down test the tablets of the sample were rubbed down in a controlled manner on a wet fabric. An assessment was made on each of 3 days.

Sogginess is reported as the product of:

a. The sogginess rating b. Fractional area of the tablet underface affected by that rating.

The sogginess is assessed visually on the scale:

0 — Dry
1 — Moist but not sticky
2 — Wet but not sticky
3 — Slightly sticky
4 — Sticky
5 — Slightly pasty
6 — Pasty
7 — Soggy
8 — Very soggy For example, if $\frac{1}{4}$ of the underface area was slightly sticky and $\frac{3}{4}$ was soggy, the sogginess of the tablet for the day would be $\frac{1}{4} \times 3 + \frac{3}{4} \times 7 = 6$.

If the same reading was found on all 3 days, the total sogginess would equal 18. Thus sogginess is reported on a 0–24 scale.

Tests were conducted in triplicate, and average values reported. The test was conducted at 95% relative humidity, storing the tablets between wash-down under these conditions.

Sogginess of the bars "on-storage" was assessed by storing the bars at 50° and 95% humidity. All the surfaces of the bar were observed daily for 3 days, as described under "in-use sogginess." The results are reported on the 0–8 scale every day and in Table 2 the results of the 3rd day are given. Both "in-use" and "on-storage" sogginess of the bars is much less compared to the control. It is believed the presence of dicalcium orthophosphate increases the relative humidity at which sogginess commences.

The rate or wear and breaking strength of each bar were also measured and found to be satisfactory for use.

The lather volume of the four formulations of the invention was shown to be superior to the control bar by collecting the lather formed by rubbing a wet cloth three times with a bar, kneading the cloth, collecting the lather formed and measuring the volume in mls. The results are given in Table 2.

Table 2

| Bar | I | II | III | IV | Control |
|---|---|---|---|---|---|
| In-use sogginess (0 to 24 scale) | 2.3 | 5.0 | 5.0 | 2.3 | 9.3 |
| Storage sogginess at 45° C. & 90° RH after 3 days (0–8 scale) | 0 | 0 | 0 | 0 | 8 |
| Lather volume (mils) | 173 | 212 | 212 | 199 | 158 |

Detergent bars V and VI or the invention made with linear alkyl benzene sulphonate and a control bar (B) containing components as set out in Table 3 were prepared as described earlier.

Table 3

| Bar | V | VI | Control B |
|---|---|---|---|
| Sodium linear alkyl ($C_{12}$) benzene sulphonate | 18 | 18 | 18 |
| Dicalcium orthophosphate | 19 | 18 | Nil |
| Sodium alkaline silicate | 10 | 10 | 7 |
| Sodium tripoly phosphate | 15 | 15 | 12 |
| Talc | 14 | 14 | 13 |
| Wax | 6 | 6 | 6 |
| Sodium carbonate | Nil | Nil | 10 |
| Starch | Nil | Nil | 12 |
| Sodium carboxy methyl cellulose | 2 | 2 | 2.3 |
| Urea | 1 | 2 | Nil |
| Moisture | 14 | 15 | 13 |
| Other inorganics | Rest | — | Rest |

The amount of each component is given approximately in weight percentage expressed as the anhydrous materials.

The weathering time required to set the plodded bar to be fit for stamping was measured by the penetration values using cone penetrometer with overall cone weight of 250g. Average of 10 measurements for the experimental bars and the control-B, immediately after penetration and after half an hour, 1 hour and 2 hours are given in Table 4.

Table 4

| Time of measurements hours after preparation | Penetration value (1 unit = 1/10mm) | | |
|---|---|---|---|
| Bar | V | VI | Control B |
| 0 | 54 | 64 | 50 |
| 0.5 | 28 | 31 | 32 |
| 1.0 | 22 | 25 | 30 |
| 2.0 | 18 | 25 | 30 |

The results show that the experimental bars are weathered within an hour while the control bar is not fit for stamping, i.e., not hard enough even at the end of 2 hours.

On-storage sogginess

Tablets were kept in a humidity chamber at 50° and 95% humidity. The sogginess values were tested at intervals of 24 hours as per the same method as described earlier. The results are given in Table 5.

Table 5

| Time of storage (hrs) | Sogginess units (0–8 scale) | | |
|---|---|---|---|
| Bar | V | VI | Control B |
| 24 | 0 | 0.5 | 5.5 |
| 48 | 1 | 3 | 8 |
| 96 | 2 | 3 | 8 |

The results indicate that experimental bars are much less soggy as shown on accelerated storage conditions.

What we claim is:

1. A detergent formulation in bar form containing from about 15% to about 65% by weight of detergent active material, from about 5% to about 60% by weight of detergency builder material, from about 1% to about 40% by weight of alkaline earth metal hydrogen orthophosphate of formula $XHPO_4$ wherein X is calcium or magnesium or mixture thereof, and about 5% to about 30% sodium alkaline silicate, the remainder being conventional ingredients.

2. A detergent formulation as claimed in claim 1 containing at least about 5% of the alkaline earth metal phosphate.

3. A detergent formulation as claimed in claim 1, wherein the detergent active material includes a water soluble salt of linear alkyl ($C_8$ to $C_{20}$) benzene sulphonate.

* * * * *